United States Patent [19]

Bogucki

[11] 4,229,628

[45] Oct. 21, 1980

[54] COMBINED DAMPER AND THREAD BREAKAGE SENSOR FOR TEXTILE MACHINES

[75] Inventor: Bogdan Bogucki, Obertshausen, Fed. Rep. of Germany

[73] Assignee: Karl Mayer Textilmaschinenfabrik GmbH, Obertshausen, Fed. Rep. of Germany

[21] Appl. No.: 931,779

[22] Filed: Aug. 7, 1978

[30] Foreign Application Priority Data

Aug. 17, 1977 [DE] Fed. Rep. of Germany ..... 2736979

[51] Int. Cl.[3] ..... B65H 25/14

[52] U.S. Cl. ..... 200/61.18; 19/0.25; 28/186; 139/354

[58] Field of Search ..... 28/186, 187; 139/353, 139/354, 336; 19/0.25; 57/78, 81; 340/675, 677, 689, 52 H; 200/61.13, 61.14, 61.18, 301, 285

[56] References Cited

U.S. PATENT DOCUMENTS 2,237,341 4/1941 Dungler ..... 200/61.13

3,999,178 12/1976 Hamilton ..... 340/689

FOREIGN PATENT DOCUMENTS 811704 4/1959 United Kingdom ..... 200/61.13

*Primary Examiner*—J. V. Truhe

*Assistant Examiner*—Morris Ginsburg

*Attorney, Agent, or Firm*—Omri M. Behr; Martin Sachs

[57] ABSTRACT

A combined damper and thread breakage sensor for use with textile machines includes a housing having a non-conducting medium disposed therein and a first contact and a second contact means immersed in the medium. The second contact extends beyond the housing and is provided with means for guiding the thread in a first position. Upon breakage of the thread the second contact moves to a second position coming into electrical contact with the first contact thereby completing an electrical circuit path of an external circuit. The completed electrical circuit path causes the circuit to shut down the textile machine, thus preventing the fabrication of defective material. The movable contact is provided with a portion which offers resistance to the non-conducting medium thereby additionally functioning to dampen out any sudden and intermittent changes in the thread tension.

9 Claims, 2 Drawing Figures

COMBINED DAMPER AND THREAD BREAKAGE SENSOR FOR TEXTILE MACHINES

BACKGROUND OF THE INVENTION

1. Field of the Invention

The present invention relates to a combined damper and thread breakage sensor for textile machines, and in particular, relates to a damper and thread sensor which is capable of reliable operation in an environment having excessive amounts of dirt, dust and high humidity.

2. Description of the Prior Art

Generally, the prior art sensing devices are protected against dirt and dust. However, they are not protected against high humidity. Unfortunately, in textile manufacturing it is necessary to operate the machines under conditions of high humidity which leads to the corrosion of the contact surfaces in a relatively short time. With corroded contact surfaces, thread breakage goes undetected, thereby bringing about needless interruption of the manufacturing process as well as, tedious restoration work. Therefore, a device that can provide a means for sensing thread breakage as well as providing damping thereto, which is reliable and can operate in the environment surrounding textile machines is highly desirable.

The present invention overcomes the shortcomings of the prior art by placing the electrical contacts in an electrically non-conducting corrosion resisting medium, where the movable contact interacts with the medium and provides damping for the thread. Thus, it is now possible to operate in a substantially friction-free manner without being concerned with the corrosive effects of the atmosphere and with confidence that thread breakage will be clearly indicated.

A combined damper and thread breakage sensor for textile machines, according to the principles of the present invention comprises, a housing having means for retaining an electrically non-conducting medium. A first contact means is disposed within the housing within the non-conducting medium and is adapted to be coupled to an electrical circuit means. A second contact means is disposed within the non-conducting medium and extends beyond the housing. The second contact means includes a means for guiding the thread in a first position, in a second position, caused by thread breakage, the second contact moves into electrical contact with the first contact means thereby completing an electrical circuit path for a circuit means which deactivates the textile machine.

BRIEF DESCRIPTION OF THE DRAWINGS

The invention will now be described in greater detail, by way of example, with reference to the drawings, in which.

DESCRIPTION OF THE PREFERRED EMBODIMENTS

Figure 1:
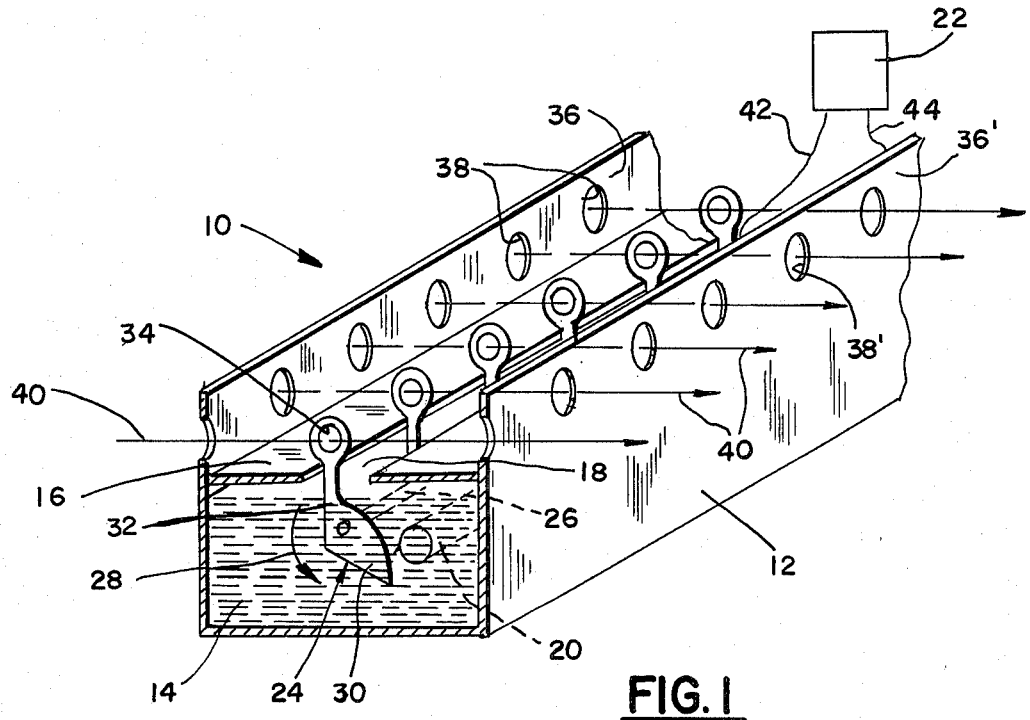
FIG. 1 is a pictorial representation in perspective of a combined damper and thread breakage sensor, according to principles of the present invention.

Referring now to the figures, and in particular to FIG. 1, there is shown a combined damper and thread breakage sensor for use with textile machines, not shown. The combined damper and thread breakage sensor 10 includes a housing 12 that is provided with a fluid preferably a liquid 14, which is electrically non-conducting and provides protection from corrosion. The liquid 14 may be a mineral oil or any synthetic oil having the aforesaid characteristics. The liquid 14 fills the housing 12 until the level of its cover 16, which is provided with an elongated slot or opening 18 that extends essentially the full length of the housing 12. Submerged in the liquid 14 is a fixed electrical contact 20 which is adapted to be coupled to an electrical circuit means 22. The electrical circuit means 22 is part of the control circuitry of the textile machine, not shown.

A second electrical contact 24 is provided proximate contact 20. Contact 24 is adapted to be rotated about shaft 26 in the direction of arrow 28. The lower portion 30 of contact 24 is elongated and broadened and adapted to interact with the liquid 14 thereby providing a damping effect when moved suddenly. The upper portion 32 of contact 24 extends upwardly through the opening 18 of the cover 16 and is preferably provided with an aperture 34 at its upper extremity. The center of gravity of contact 24 is chosen to be to the left of shaft 26 so that if contact 24 is permitted to fall freely it would fall in the direction of arrow 28. A plurality of contacts 24 may be included on shaft 26 each one being identical to contact 24 having the upper portions thereof extending upwardly through the opening 18 in the cover 16 of the housing 12.

In the preferred embodiment of the invention the upper portion of the walls 36 are provided with a plurality of apertures 38 through which the threads 40 are passed. The threads 40 enter the apertures 38, pass through the aperture 34 and exit via the apertures 38' provided in the opposite wall 36' of the housing 12. Thus, the threads 40, when they are kept taut prevent the contacts 24 from rotating in the direction of arrow 28. If threads 40 should break or become loose, contact 24 will be free to rotate in the direction of arrow 28 by virtue of its center of gravity appearing to the left of shaft 26. The lower portion 30 of contact 24 would be caused to rise and come into contact with the stationary contact 20 thereby completing an electrical path from contact 24 to 20. Thus, the path from the circuit means 22 which travels via a wire 42 through contact 24 to contact 20 and via a wire 44 back to the circuit means 22 is now completed. Completing the circuit path for the circuit means 22 enables it to stop the machinery, thereby preventing the manufacture of defective goods because of a boken thread.

Since the movable contact 24 is kept in its upright position by the threads 40 it continually interacts therewith. Any sudden changes in tension on the threads 40 would be caused to be taken up or dampened by virtue of the lower portion 30 of contact 24 interacting with the liquid medium 14 which covers the complete lower portion 30 of contact 24.

Figure 2:
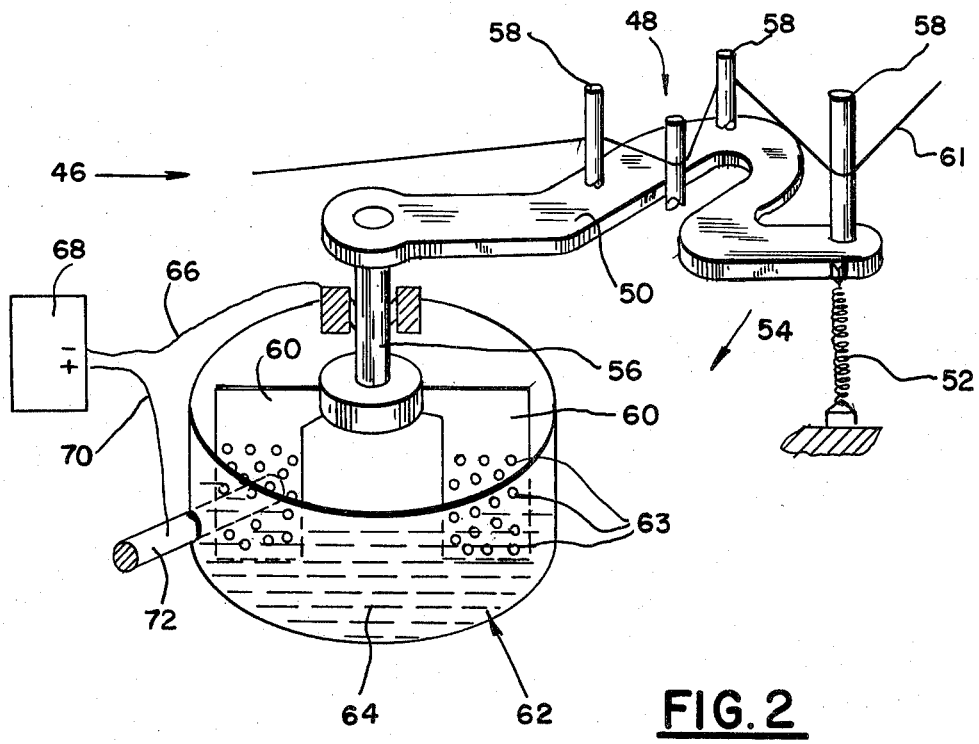
FIG. 2 is an alternate embodiment of a combined damper and thread breakage sensor for a textile machine.

An alternative embodiment 46 of the present invention is shown in FIG. 2. The embodiment in FIG. 2 further includes a brake portion 48 which includes a lever arm 50 which has a spring means 52 affixed to one end thereof. The spring 52 urges the lever in the direction of arrow 54. The opposite end of lever 50 is affixed, in a conventional manner, to a rotatable shaft 56. The lever 50 is provided with a staggered grouping of pegs 58 around which the thread 61 is guided. The spring 52 acting against lever 50 urges it in the direction of arrow 54 thus applying tension to the thread 61 and functions as a braking mechanism.

Affixed to the end of rotatable shaft 56 are a pair of paddles 60 which extend into a housing 62 filled with a liquid 64 similar to that described in connection with FIG. 1. The paddles 60 function as a movable contact means and are electrically connected via rotatable shaft 56 and a wire 66 to an electrical circuit means 68 which is part of the electrical circuit control for the textile machine, not shown. A second wire 70 is connected to a fixed electrical contact 72 which extends into the housing 62 and is immersed in the liquid 64. The contact 72 under normal operation is not in intimate contact with the paddles 60.

In operation, the spring 52 provides braking tension to the thread 61, and as stated earlier, no contact is made between contact 72 and contact 60. Here again, as in the earlier embodiment shown in FIG. 1, any sudden movement or change in tension on thread 61 will be dampened by the interaction of the paddles 60 with the liquid 64. The paddles 60 may be provided with perforations 63 to alter their damping characteristics. If the thread 61 should break or become very loose spring 52 would urge lever arm 50 in the direction of arrow 54 thus causing paddle 60 to come into intimate contact with contact 72 thereby completing an electrical path from the circuit means 68 via wire 70, contact 72, shaft 56 and wire 66 to the circuit means 68. Completing the circuit path thus described causes the circuit means to interrupt the control mechanism of the textile machines, thereby stopping the manufacture of material.

Hereinbefore has been disclosed a combined damper and thread breakage sensor for textile machines that is capable of operating in an environment which may be filled with dust, dirt and of high humidity in a consistent trouble free manner. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A combined damper and thread breakage sensor for textile machines, comprising:

(a) a housing having means for retaining an electrically non-conducting liquid;

(b) first contact means disposed within said non-conducting liquid adapted to be coupled to an electrical circuit means;

(c) second contact means, disposed within said non-conducting liquid, said second contact means extending beyond said housing and having means for guiding thread in a first position, said second contact means moving about a pivot point to a second position upon breakage of said thread and coming into electrical contact with said first contact means, said second contact means being adapted to be coupled to said electrical circuit means, said first and second contact means completing an electrical circuit path of said electrical circuit means when in intimate contact.

2. A combined damper and thread breakage sensor according to claim 1, wherein one contact means is stationary and one contact means is movable.

3. A combined damper and thread breakage sensor according to claim 1, wherein said thread guiding means includes spring bias means disposed outside of said housing for biasing said second contact means towards said first contact means.

4. A combined damper and thread breakage sensor according to claim 3 wherein said thread guiding means further includes a plurality of staggered pegs around which said thread is guided, said guiding means functioning as a braking means.

5. A combined damper and thread breakage sensor according to claim 1, wherein the walls of said housing contain thread guides which are in line with the guide means of said second contact means in said first position.

6. A combined damper and thread breakage sensor according to claim 1, wherein said second contact means includes means for interacting with said housing liquid to provide damping.

7. A combined damper and thread breakage sensor according to claim 6, wherein said interacting means are paddles extending outwardly into said medium from the pivot point of said second contact means.

8. A combined damper and thread breakage sensor according to claim 7, wherein said paddles are shaped and perforated to alter the damping characteristics thereof.

9. A combined damper and thread breakage sensor according to claim 7, wherein said paddles complete said electrical contact with said first contact means in said second position.

* * * * *